US006705463B1

(12) United States Patent
Bucholtz et al.

(10) Patent No.: US 6,705,463 B1
(45) Date of Patent: Mar. 16, 2004

(54) FLIP TOP GOLF BALL CONTAINER ASSEMBLY PROVIDED WITH MOISTURE BARRIER PROPERTIES

(75) Inventors: Michael Bucholtz, Ballston Spa, NY (US); William Abrams, Auburn, AL (US); Ronald Supranowicz, Lenox, MA (US)

(73) Assignee: CSP Technologies, Inc., Amsterdam, NY (US)

( * ) Notice: Subject to any disclaimer, the term of this patent is extended or adjusted under 35 U.S.C. 154(b) by 0 days.

(21) Appl. No.: 09/876,381

(22) Filed: Jun. 7, 2001

Related U.S. Application Data

(60) Provisional application No. 60/210,113, filed on Jun. 7, 2000.

(51) Int. Cl.[7] ..... B65D 85/58
(52) U.S. Cl. ..... 206/315.9
(58) Field of Search ..... 206/315.1, 315.9, 206/204, 579; 220/326, 836, 839; 224/919

(56) References Cited

U.S. PATENT DOCUMENTS 1,050,706 A * 1/1913 Taylor ..... 206/315.9
4,267,928 A * 5/1981 Curry, Jr. ..... 206/583
5,667,094 A * 9/1997 Rapchak et al. ..... 220/839
5,875,891 A * 3/1999 Snell ..... 206/315.9
6,398,067 B1 * 6/2002 Belfance et al. ..... 220/839

* cited by examiner

*Primary Examiner*—Luan K. Bui
(74) *Attorney, Agent, or Firm*—Greenberg Traurig LLP

(57) ABSTRACT

A golf ball and package assembly, comprising: at least one golf ball; a package separable from said golf ball defining a cavity within which said golf ball is positioned, said package comprising: (a) a moisture proof, resealable container and an integrally attached cap, wherein the package has a base, an internal cavity, an outer surface, an upper portion and lower portion, a rim at the upper portion, the cap has a base and a skirt extending perpendicularly around the outer periphery of the base, the cap is provided with a thumb tab for facilitating the opening and closing of the container, and is attached to the package by a hinge; (b) the cap and container are non-circular in shape having curved sides and flat sides, joined by rounded corners; (c) an outer wall of the ridge and wall surfaces of the cap rim define a gap into which rim is fitted to form a moisture proof seal when the cap is in the closed position; and (d) a desiccant insert.

10 Claims, 9 Drawing Sheets

Shelf Life Calculations Based upon Moisture Ingress for a Part weight of 4.5 grams and 60% Molecular Sieve

| Ingress (micrograms/day) | Total Days Capacity |
|---|---|
| 500 | 1242 |
| 750 | 828 |
| 1000 | 621 |
| 1250 | 497 |
| 1500 | 414 |
| 1750 | 355 |
| 2000 | 311 |

FLIP TOP GOLF BALL CONTAINER ASSEMBLY PROVIDED WITH MOISTURE BARRIER PROPERTIES

RELATED APPLICATION

This application claims priority to provisional application Serial No. 60/210,113, filed Jun. 7, 2000.

BACKGROUND OF THE INVENTION

1. Field of the Invention

The present invention relates to an improved container assembly for golf balls, and more particularly, relates to a golf ball packaging that preserves the mechanical and physical characteristics of the ball during storage and transport.

2. Description of the Related Art

Golf balls generally come in two different varieties, solid golf balls and multi-piece golf balls. A solid golf ball consists of a polymeric sphere having a plurality of molded dimples which aid the flight characteristics of the golf ball. Solid golf balls are usually used for practicing, where high performance is not a priority, such as in driving ranges. Multi-piece golf balls exhibit better playing characteristics than solid golf balls and are consequently used on golf courses during play. A multipiece golf ball consists of either a wound or solid rubber core that is covered with a separate and distinct cover. The cover often comprises a single thermoplastic layer. Recently, new types of multi-piece golf balls have been introduced having a multilayered compound including a plastic mantle surrounding a solid polybutadiene rubber core and an external thermoplastic envelope. The solid core or the center of a wound core is generally made of an elastomer, such as a CIS content polybutadiene rubber which is combined with a zinc or other metal salt of unsaturated fatty acid. Often, small amounts of zinc oxide are also added to the core in order to achieve a higher performance in restitution, as described below.

The cover of a multi-piece golf ball is typically made from a material that contributes to the durability of the ball and also provides the particular "feel" characteristics of the ball when struck with a club. By way of example, a two-piece golf ball construction of a rubber core and an ionomer cover generally provides a very durable ball and also provides maximum traveling distance to the ball when struck with a club.

Golf ball manufacturers have recently introduced a new type of two-piece golf ball for use by tour players. The new golf balls provide a softer feeling to the ball when struck with a club. Manufacturers have achieved this characteristic by lowering the core compression and softening the cover of the golf ball. Golf ball manufacturers have also recently developed a three-layer golf ball having an intermediate mantle between the core and the cover. The three-layer golf ball provides a softer feel to the golf ball while also providing maximum distance and durability.

Unfortunately, multi-piece golf balls typically absorb moisture when they are subjected to prolonged storage under ambient conditions of temperature and humidity. A short period of moisture absorption can cause significant changes in the performance characteristics of the ball. Such moisture absorption may affect the weight of the ball, as well as the physical and mechanical characteristics of the various materials that make up the different pieces of the golf ball structure, including the cover, the core and the mantle.

One other characteristic that is affected by moisture absorption is the initial velocity of the golf ball. United States Golf Association (USGA) rules govern the allowable ranges of initial velocity values for golf balls. According to the USGA rules, the initial velocity must not exceed a value of 250 feet per second, with a maximum tolerance of 2%. Consequently, golf ball manufacturers have sought to manufacture golf balls that have an initial velocity as close as possible to the 255 feet per second limit, without exceeding this value.

As described in U.S. Pat. No. 5,875,891, moisture has been shown to adversely affect the initial velocity of a ball over a very short period of time. According to this reference, "the initial velocity loss is approximately 2.5 ft/sec. over twelve months for golf balls having a soft cover, between 50 to 60 shore D, in an environment of 72° F. and 50% of relative humidity (RH). Such a initial velocity loss of 2.5 ft/sec. corresponds to a loss of distance of approximately 6 to 10 yards when the ball is struck with a driver. For a golf ball having a hard cover, between 68–72 shore D in the same conditions, the initial velocity loss over 12 months is approximately 0.5 ft/sec."

The problem of moisture absorption is particularly acute for soft cover balls because the soft cover is more permeable to moisture than a hard cover, so the moisture reaches the core more easily. Because it is made of a highly hygroscopic material, the core absorbs this moisture, which degrades the desired properties of the core. The degradation in performance characteristics is generally accelerated when the ambient storage temperature becomes higher. For a soft cover ball at a temperature around 110° F. and 50% RH, a velocity loss of 2.5 ft/sec may occur in only a few weeks, as opposed to twelve months for a soft cover ball in an environment of 72° F. and 50% RH. During transportation of the golf ball from the manufacturing facility to a retail store, actual storage conditions are closer to these conditions. Consequently, soft cover balls may experience a large reduction in performance characteristics when being transported from the manufacturing facilities to the retail store.

U.S. Pat. No. 5,875,891 discloses a packaging for golf balls that acts as a barrier inhibiting moisture absorption by a golf ball during storage. In one embodiment, the packaging includes a sealing member that defines an internal closed volume that is configured to receive golf ball(s). The sealing member preferably has a laminate structure that includes a moisture barrier layer, a sealing layer and a structural layer. According to the reference, "There is therefore a need for a packaging that may be used to store golf balls prior to first use and prevent the damage associated with difficult storage and shipping conditions, such as temperature and moisture. Such a packaging should sufficiently protect the golf ball to ensure the freshness of the golf ball and preserve the optimum properties of the golf ball prior to first use, while also preserving and protecting the structure of the ball. The packaging should be both capable of protecting single or multiple golf balls and retaining the physical and mechanical properties of the ball, such as the initial velocity value, until the packaging is opened." The reference purports to satisfy these needs. U.S. Pat. No. 5,875,981 at col. 3 lines 49–65.

U.S. Pat. Nos. 4,783,056 and 4,812,116, the latter being a divisional of the former, disclose a mold and a process for making an aseptic vial and cap. The teachings of these references are incorporated herein by reference.

Co-pending U.S. application Ser. No. 09/386,702 filed on Aug. 31, 1999, and assigned to the same assignee as the present application, discloses a leakproof, resealable container and cap assembly which comprises a cap and container attached by a hinge. The container has an upper portion and an outer surface, and at the upper portion, the container has a rim. The cap has a circular base portion with an outer periphery and a cylindrical tubular skirt extending perpendicularly and outwardly around said outer periphery of the base; the skirt has an inner wall which includes at least one recess. In another embodiment, the cap has opposing ends; the cap has a thumb tab for facilitating the opening and closing of the container and the hinge attached to the container. The thumb tab and hinge are positioned on opposing ends of the cap and extend perpendicularly and outwardly from the skirt of the cap. In a further embodiment, the skirt of the cap overlies the container and the rim of the container is situated within the recess of the inner wall of the skirt of the cap during a closed position. The container may also be provided with a flange projecting radially outwardly from the outer surface of the container. The hinge may be attached to the container flange and the skirt of the cap is designed to overlie the rim of the container and be in uniform close proximity to the container flange during the closed position. The cap and container assembly, when in the closed position, form a leakproof, air tight seal. The cap and container may be integrally molded of plastic, forming a hinge therebetween.

SUMMARY OF THE INVENTION

The present invention relates to a resealable container and cap assembly for storing and packaging golf balls. The container substantially prohibits the ingress of moisture into the container through the lid when the container is sealed. In other words, it is substantially moisture-proof. In another aspect of the invention, the container assembly is provided with a desiccant or similar material which reduces the moisture present within the container when it is sealed. That is, after the container has been sealed, the desiccant absorbs moisture present in the cavity. Likewise, after the container has been opened and then resealed, the desiccant absorbs moisture that entered the cavity when the container was opened.

In one embodiment of the present invention, the assembly comprises a cap and container that may be attached by a hinge. The container has an upper portion and an outer surface, and at the upper portion, the container has a rim. The cap has a base portion with an outer periphery and a skirt extending perpendicularly and outwardly around said outer periphery of the base; the skirt has an inner wall. The cap sealingly engages with the upper portion of the container which provides a seal between the interior of the container and the outside environment.

The container and cap may be non-circular in shape. For instance, the container and cap may be provided with corners, either squared or rounded. The container and cap may be any non-circular shape, such as a triangle or an ellipse, without regard to whether the shape is symmetrical or not. Although the container and cap may take a circular shape, non-circular shapes may be preferable since it permits the user to insert a finger or object into the container and remove a ball, rendering the inversion of the container to remove a ball unnecessary.

In another embodiment, the cap has a thumb tab for facilitating the opening and closing of the container, and a hinge is attached to the container. The thumb tab and hinge are positioned on opposing ends of the cap and extend perpendicularly from the skirt of the cap. In a further embodiment, the skirt of the cap overlies the rim of the container and the rim of the container is situated within a recess of the inner wall of the skirt of the cap during the closed position.

The container may also be provided with a flange projecting radially outwardly from the outer surface of the container. The hinge may be attached to the container flange and the skirt of the cap is designed to overlie the rim of the container and be in uniform close proximity to the container flange during the closed position. The cap and container assembly, when in the closed position, form a leakproof, moisture proof seal. The cap and container may be integrally molded of plastic, with the hinge formed therebetween.

In a further embodiment, the hinge of the assembly has a recess positioned between two elements, the first element being attached to the skirt of the cap and the second element being attached to the container. The recess may be a piece of thermoplastic integral with the two elements, the recess being relatively thinner than the two elements. In still a further embodiment, the recess functions as a bending point during the opening and closing of the container.

In a further embodiment a ridge is provided on the base of the cap and extends perpendicularly in the direction of the skirt. The ridge is positioned a distance away from the skirt which approximately corresponds to the thickness of the rim and/or upper portion of the container. This arrangement creates a gap between the ridge and the skirt. When the cap is closed onto the container, the rim of the container resides within the gap. Together, the ridge, skirt, and rim forming a substantially moisture proof seal.

While the present invention is described in terms of providing a moisture proof container for the packaging and storing of golf balls, is it evident that this container can be used to store any of a number of other items that would benefit from being packaged and stored in a dry environment.

DETAILED DESCRIPTION OF THE PRESENT INVENTION

The present invention relates to a moisture proof, resealable container and lid assembly. The term "resealable" means that the closure can be closed at least once after the container is opened for the first time. Preferably, the closure can be opened and closed additional times after the initial opening.

In another embodiment, the cap and container assembly, in a closed position, forms a moisture proof seal. The term "moisture proof" refers to a rate of ingress of moisture into a sealed container of about 500 $\mu$g/day or less determined by the test method of the example.

Figure 1:
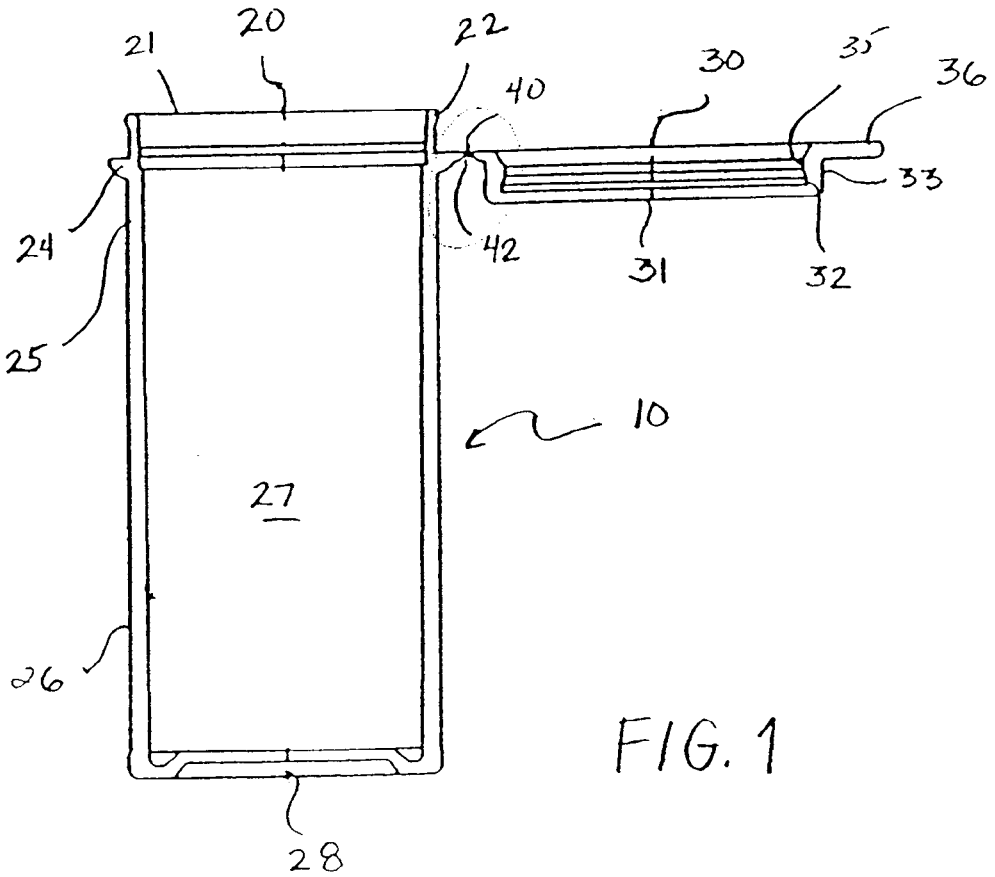
FIG. 1 is a side view of one embodiment of the present invention.
Figure 2:
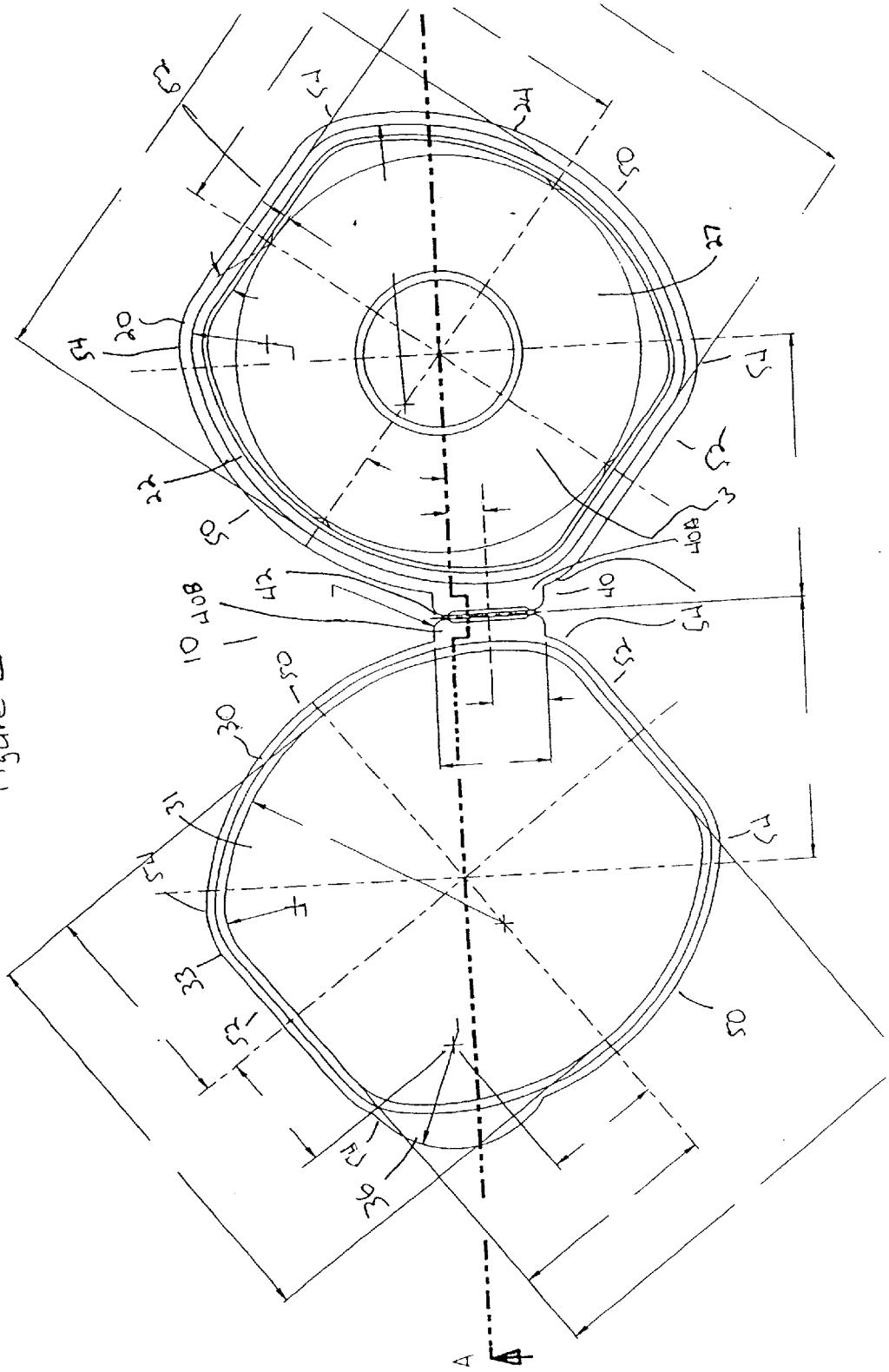
FIG. 2 is an top plan view of the embodiment of FIG. 1.

Referring now to FIGS. 1 and 2, where one embodiment of the resealable cap and container assembly 10 of the present invention is illustrated, the assembly 10 includes a container 20 having a base 28, an internal cavity 27, an outer surface 25, an upper portion 21 and lower portion 26. The container 20 has a rim 22 at the upper portion 21. The assembly 10 also has a cap 30 which has a base 31 and a skirt 33 extending perpendicularly around the outer periphery of the base 31. The cap 30 is provided with a thumb tab 36 for facilitating the opening and closing of the container, and is attached to the container 20 by hinge 40. The tab 36 and hinge 40 are preferably positioned on opposing ends of the cap and extend perpendicularly from the skirt 33 of the cap 30. A desiccant puck 3 can be seen sitting at the bottom of the container in FIG. 2.

The container may also have a flange 24 projecting radially outwardly from the outer surface 25 of the container 20. The hinge 40 may also be attached to the container flange 24. The hinge 40 also has a recess 42 that functions as a bending point during the opening and closing of the container. The hinge 40 has two elements, 40A and 40B, respectively, formed on either side of the recess. One element 40A is attached to the flange 24 of the container 20 and the second element 40B is attached to the cap 30.

As illustrated in FIG. 2, the cap and container are non-circular in shape. The cap and container each have curved sides 50 and flat sides 52, joined by rounded corners 54. A non-circular shape can facilitate the removal of a golf ball without the need to invert the container, as discussed above. Any kind of non-circular shape can be used in this invention, without regard to whether the shape is symmetrical or asymmetrical. Suitable shapes include the square, triangle, ellipse, rectangle, trapezoid, and numerous others. If the assembly is provided with corners, as is the case with the embodiment of FIGS. 1 and 2, they may be squared or rounded. Furthermore, the skilled artisan would understand that the assembly could be circular in its shape.

Figure 6:
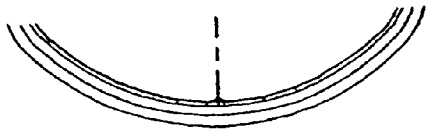
FIG. 6 is a side elevational view of an embodiment of the container and cap assembly of the present invention sized to hold three golf balls.
Figure 6:
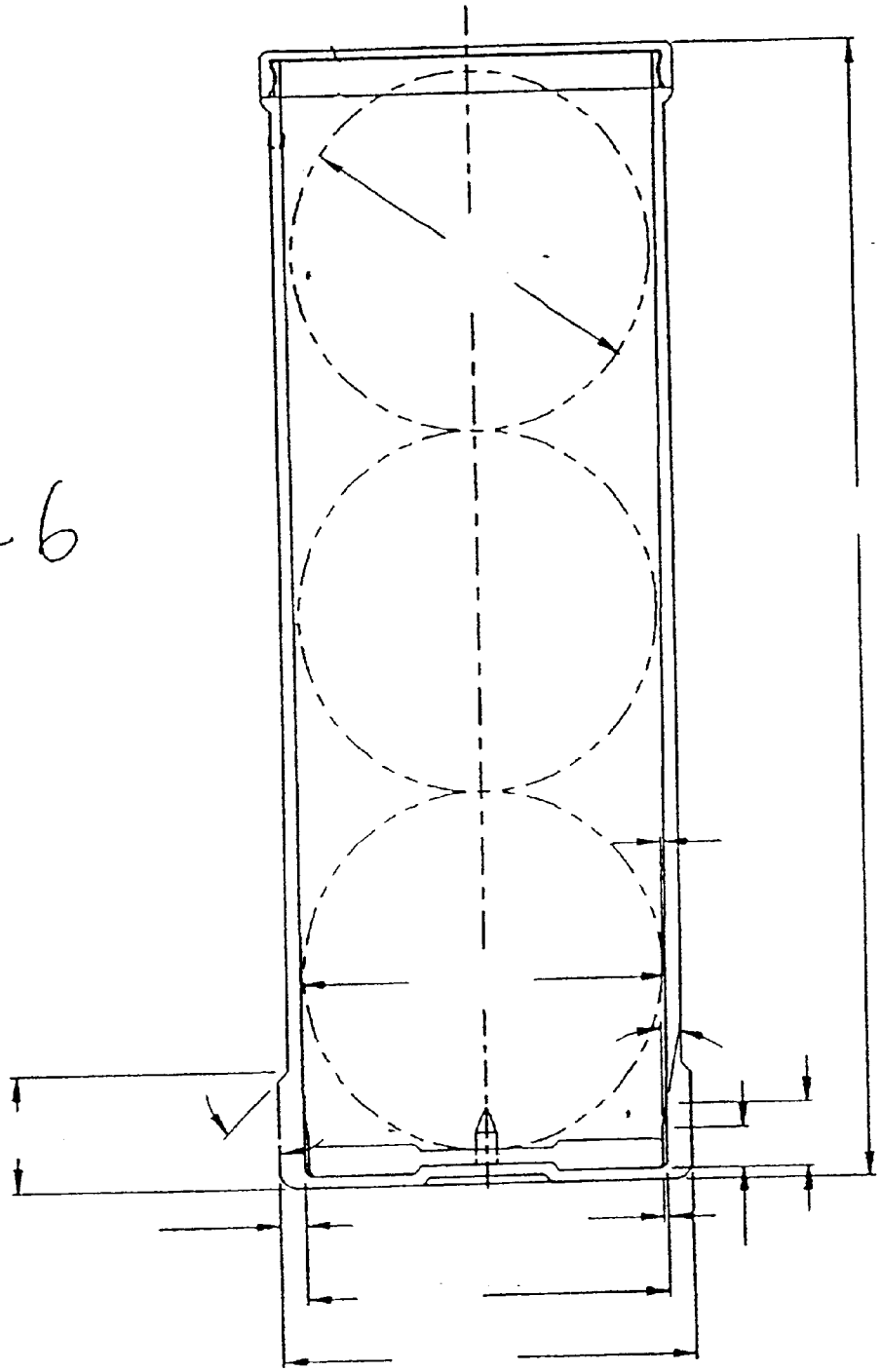

The container is sized to hold at least one golf ball. It can be sized to hold one ball, or a plurality of balls (i.e.—two, three, four, five, or any other possible number). In an exemplary depiction shown in FIG. 6, the container is sized to hold three golf balls.

Suitable material for assembly 10 includes plastic (e.g. thermoplastics such as polypropylene and polyethylene). In one embodiment, the cap 30 and container 20 may be integrally molded of the plastic to form a hinge 40 therebetween. In one embodiment, the cap 30 and container 20 may be produced in a molding process and, in another embodiment, may be molded in accordance with the mold similar to that disclosed in U.S. Pat. Nos. 4,783,056 and 4,812,116, respectively or, in another embodiment, may be produced in accordance with U.S. Pat. No. 5,723,085. The disclosure of these patents are incorporated by reference herein.

Figure 5:
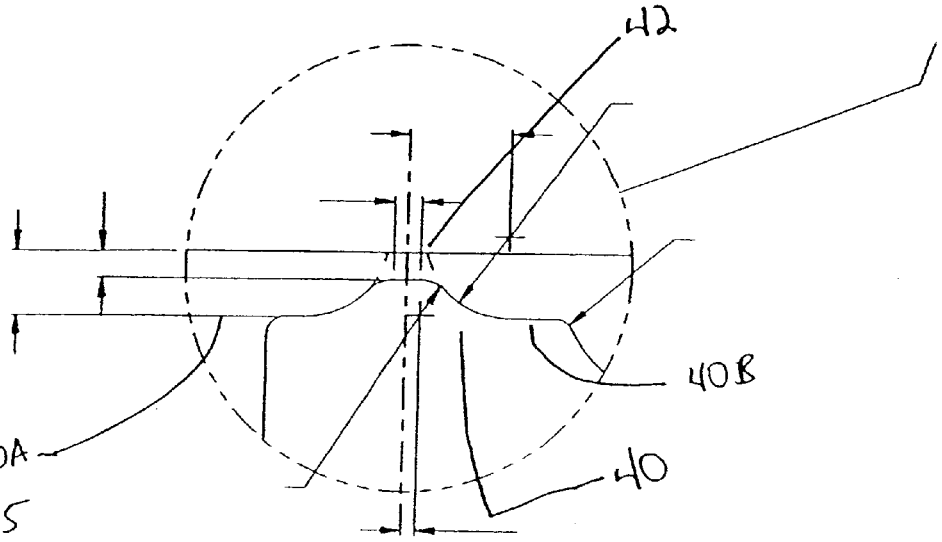
FIG. 5 is a perspective view of an embodiment of the hinge which connects the cap and container.

Turning to FIG. 5, which shows the hinge 40 of one embodiment of the present invention, the recess 42 is characterized by a relatively thinner section of plastic material which bridges thicker sections 40A, 40B of the hinge 40 . The recess 42 is a location which bends relatively easily and acts as the location where the hinge folds when the lid is closed, and as the location where the hinge opens when the lid is opened.

In another embodiment, the thumb tab 36 has a length from about 0.125 inches to about 0.325 inches, preferably 0.235 inches, measured from the outside perimeter of the cap to the end of the tab. In still another embodiment, the assembly 10 can be sealed and/or resealed by applying, in a singular motion, downward pressure upon the thumb tab or base of the cap 31 to obtain a leakproof seal. As an example a user places his or her thumb parallel or on top of the thumb tab (i.e. the frontal portion of the container) and applies a downward pressure until an audible snap is heard and then verified by visual inspection of uniform cap position around the flange. The same effect can be obtained if the user presses down upon the base of the cap 31.

Figure 3:
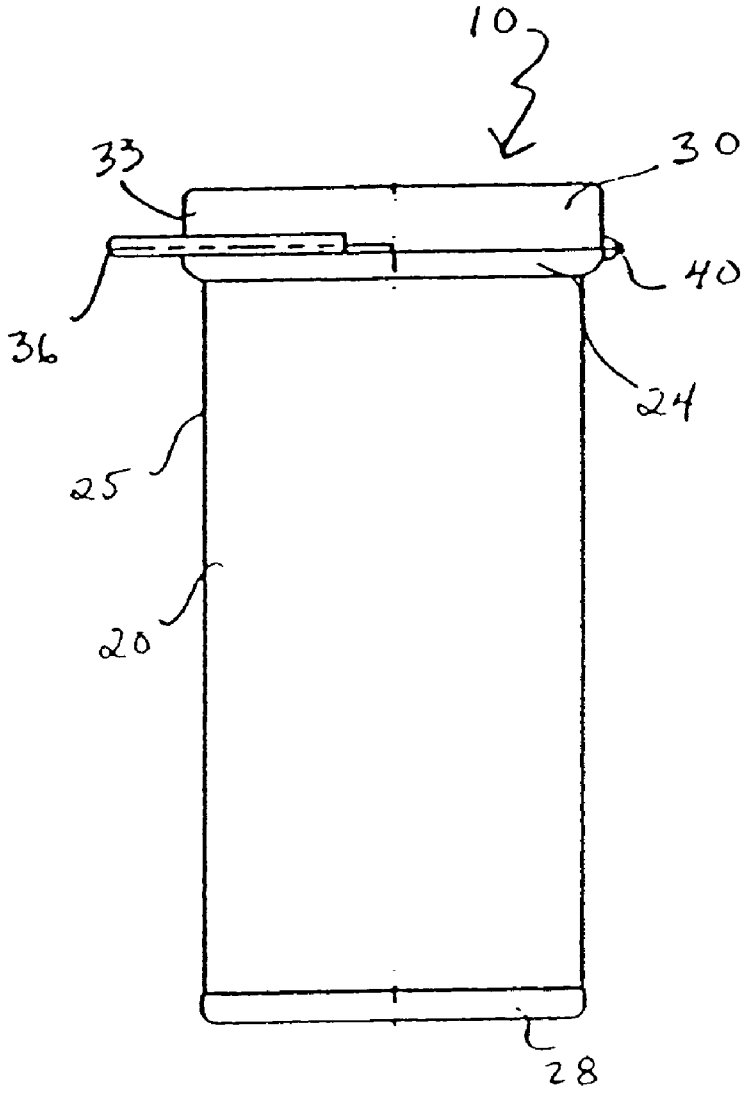
FIG. 3 is a side elevational view of an embodiment of the container and cap assembly of the present invention in a closed position.

FIG. 3 depicts a side elevational view of the present invention in a closed position. The cap and container assembly 10 comprises the cap 30 and the container 20 connected by the hinge 40. The container 20 has a flange 24 extending from the outer surface 25 and a base 28. The cap 30 has a skirt 33 and the thumb tab 36 extending perpendicular from the skirt 33. In a closed position, the skirt 33 of the cap 30 overlies the container 20 and lies upon the flange 24 of the container 20.

Figure 4:
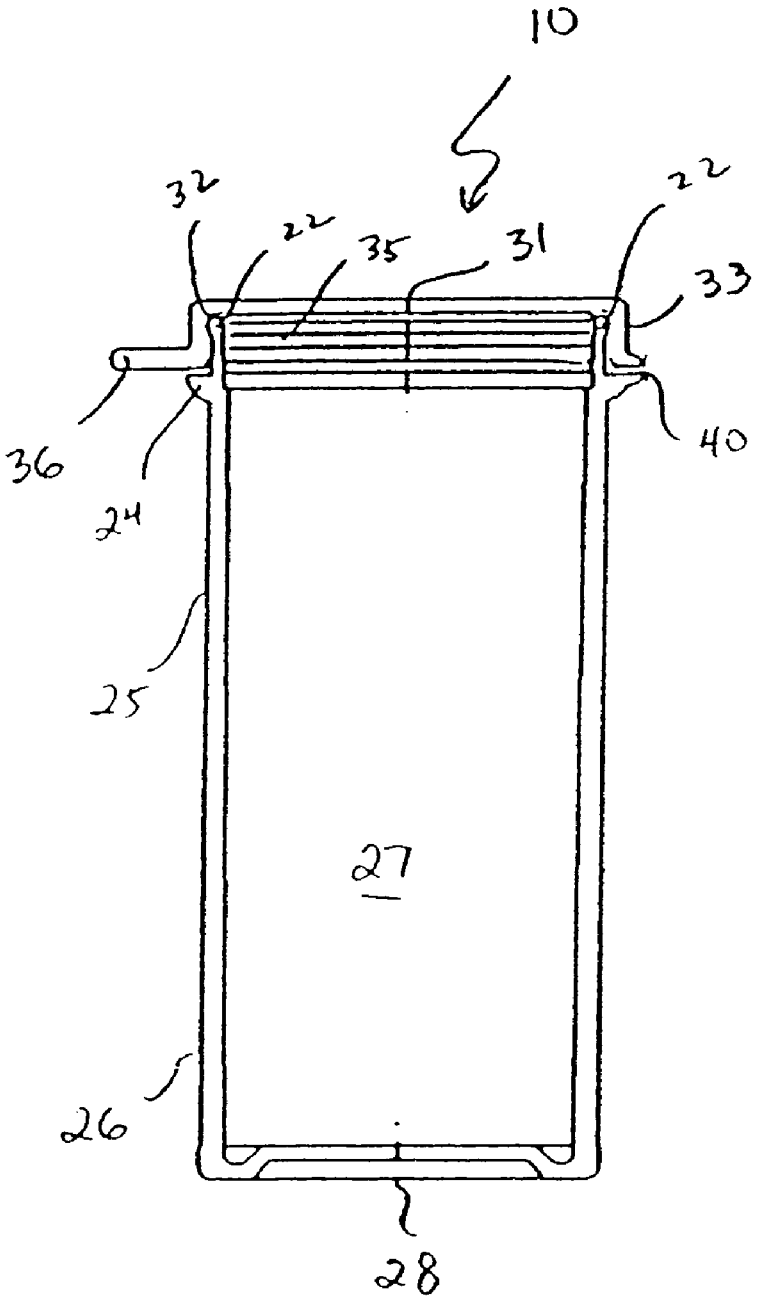
FIG. 4 is a cross-sectional side view of an embodiment of the assembly in a closed position.

FIG. 4 illustrates a cross-sectional view of the assembly 10 in a closed position. The skirt 33 of the cap 30 overlies the container 20 and lies upon the flange 24 of the container 30 while the rim 22 of the container 20 is situated within the recess 32 of the inner wall 35 of the skirt 33 of the cap 30. The container 20 can be sealed and/or resealed by applying, in a singular motion, downward pressure upon the thumb tab 36 or the base of the cap 31 to obtain a moisture proof seal.

Figure 7:
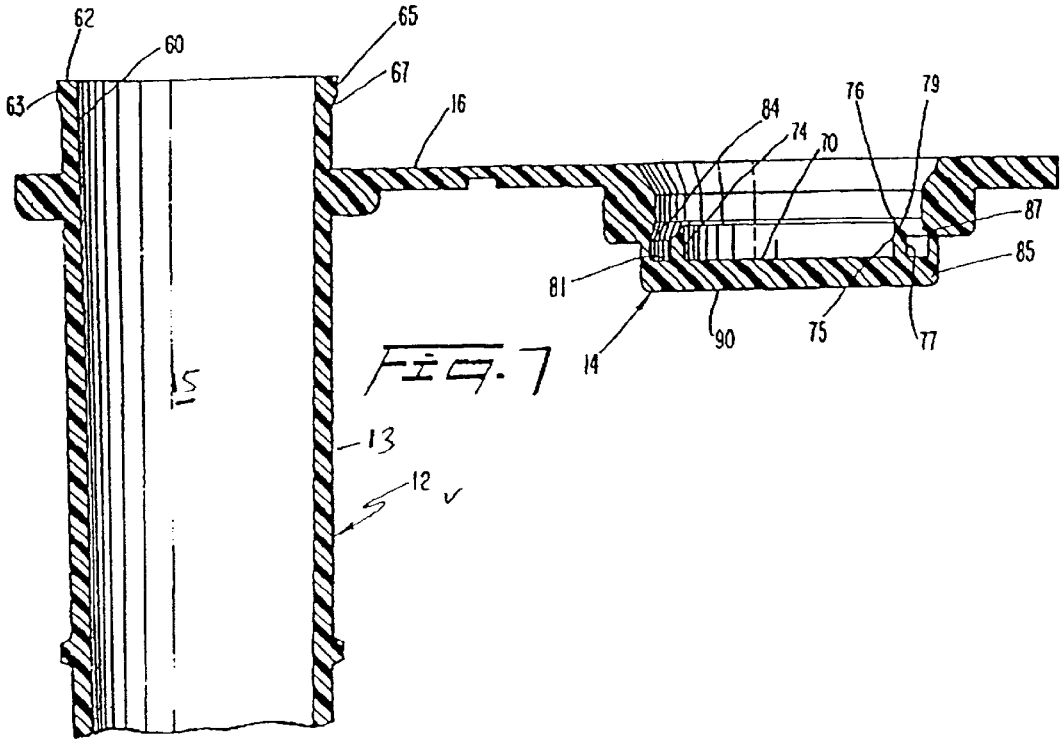
FIG. 7 is a side elevational view of another embodiment of the present invention.

FIG. 7 illustrates another embodiment of the present invention. Container 12 is provided with wall 13, which defines an internal cavity 15. The upper region of the container wall 13 is provided with a rim 63 extending around the periphery of the container 12. Rim 63 and the smooth transition surface at upper edge 62 of the container 12 form an annular region for interlocking with the cap 14. In one embodiment, the outer diameter at the rim 63 is greater than the outer wall diameter of wall 13. In one embodiment, it is about 0.025" greater. The outer diameter of the rim 63 is constant for about 0.033" at a first rim surface 65. Adjacent the first rim surface 65, a second rim surface 67 tapers down to the outer wall 13 of the container 12 over a distance of about 0.030" at an oblique angle, suitably about 21°.

The container 12 may be integrally connected to the cap 14 by means of a tab or flange 16. Cap 14 has a base 85, and a skirt 87 extending therefrom. Extending perpendicular to the skirt 87 is a thumb tab 88 for facilitating the opening and closing of the container. Ridge 74 is positioned on the interior 70 of the base 85, and extends perpendicularly therefrom. The outer wall 77 of the ridge 74 and the wall surfaces 87 of the cap rim define a gap 81 into which rim 63 is fitted to form a moisterproof seal when the cap is in the closed position. An end surface 79 of the ridge 74 interconnects the inner edge 75 with the outer edge 77.

The ridge 74, the gap 81 and the cylindrical skirt 87 combine to form an annular region for interlocking with the rim 63 on the container 12. The rim 63 is adapted to sealingly fit within the gap 81 formed between the seal 74 and the outer cap rim. The top surface 76 forms a smooth transition surface to further guide the seal 74 around the container wall.

In one embodiment, to insure that the moisture which may is enter the container assembly is absorbed so it does not adversely affect golf ball performance, a desiccant, in the shape of a disc (e.g. puck), sleeve, or other shapes, either conforms to a part of the container or is placed within the container. U.S. Pat. No. 5,911,937 discloses a process and resulting structure for producing a desiccant insert. The method of making the desiccant insert is incorporated by reference herein as an embodiment of one method of making the desiccant insert. In addition, U.S. Pat. No. 5,911,937 discloses various structures and positions in the container for the desiccant insert including a plug and a liner in the container. These structures and positions are also incorporated by reference herein as embodiments of various structures and positions of the desiccant insert.

In another embodiment, a suitable puck is constructed as follows: (a) 35% Polypropylene (Aristech manufacturer); (b) 5% Polyethylene Glycol (Dow manufacturer "E4500"); and (c) 60% Molecular Sieve (Elf AtoChem manufacturer "MS4A"). The above percentages are on a weight/weight basis. The components are blended and extruded into pellets. The pellets are injection molded into the desiccant puck. All sample components are in the solid phase. The total weight of the molded puck can be approximately 4.5 grams. In another embodiment, a desiccant may be blended with a thermoplastic material to form a suitable shape.

EXAMPLE

The moisture ingress through the flip-top seal of the container described in FIGS. 1–4 was determined over a fifty (50) day period. A total of six (6) vials were used for the study. Two vials, referred to as CONTROL A and CONTROL B, do not contain desiccant. Four other vials, referred to as Samples C, D, E, F, have 2.0 grams of loose molecular sieve (MS) powder placed inside, plus or minus 0.25 grams. The dimensions of the containers are approximately 1.8" in diameter×5.3" tall. The test method can be described as follows: (a) placing two grams plus or minus 0.25 grams of molecular sieve ("MS") into four (4) containers 1.8" in diameter×5.3" tall and recording the weight; (b) recording the weight of two of the same containers which do not contain any MS material, which containers are maintained as controls; (c) closing the containers by applying, in a singular motion, a downward pressure upon the container lids or thumb tabs until the rim portions, adjacent to the thumb tabs, contact the inside flat part of the caps also adjacent to the thumb tabs; (d) weighing the six (6) containers and recording their respective weights; (e) placing the closed containers in an environmental chamber maintained at conditions of 80% relative humidity and 72□F; (f) weighing the containers on a daily basis for fifty (50) days, recording the weights of the respective containers, and returning them to the chamber; (g) subtracting the weights recorded in steps (a) and (b) from the current day weight of the respective containers to calculate the moisture ingress of the container in units of micrograms of water; and (h) determining the moisture ingress through the seal by discounting the moisture ingress through the vial, according to the following methodology, calculated on a daily basis:

n—Sample Type (A–F)

Sn—Sample Weight Gain=(Current Vial Weight—Initial Vial Weight at Start of Study)

Ctrl—Average Weight Gain of Control Samples=(SA+SB)/2

TS—Average Weight Gain of Test Samples=(SC+SD+SE+SF)/4

MI—Moisture Ingress through Seal=(TS−Ctrl).

A relative humidity transducer is mounted in the environmental chamber. The transducer measures the relative humidity inside the chamber. The transducer is a capacitive type, composed of a thin polymer film, with a 0–100% relative humidity operating range, accuracy +3%RH from 10–90% at (−20–40□C), resolution: >0.04% between (25–60% RH).

Results

Figure 8:
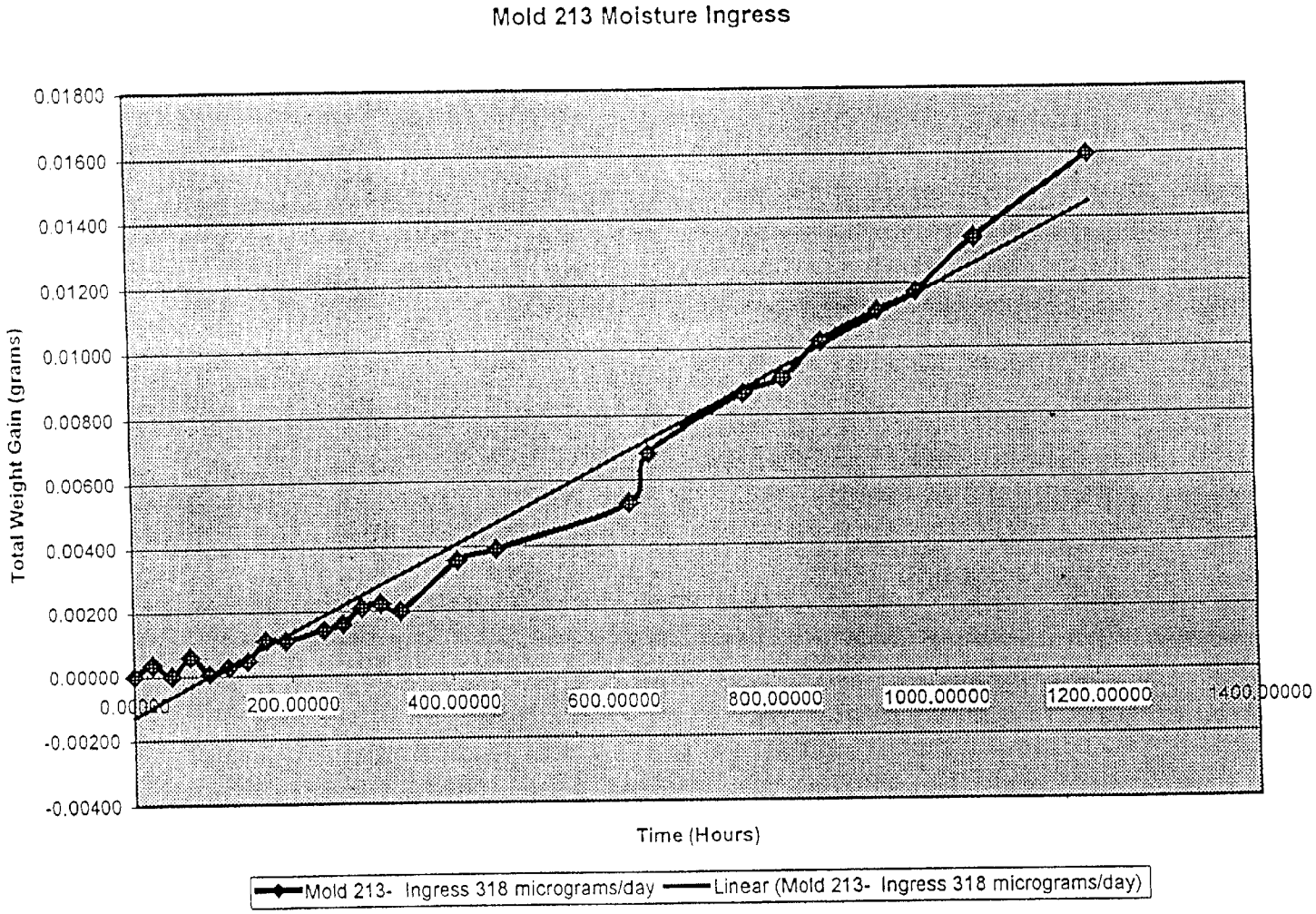
FIG. 8 is a plot of moisture ingress through the seal over a 50 day period (measured in hours)

The data collected shows that the average moisture ingress through the flip-top seal is 318 $\mu$g per day over the test period. The rate of moisture ingress is relatively constant over the test period, as shown by the plot in FIG. 8. The data is presented in Table 1. The MS absorbed approximately 5% of its total capacity.

Figure 9:
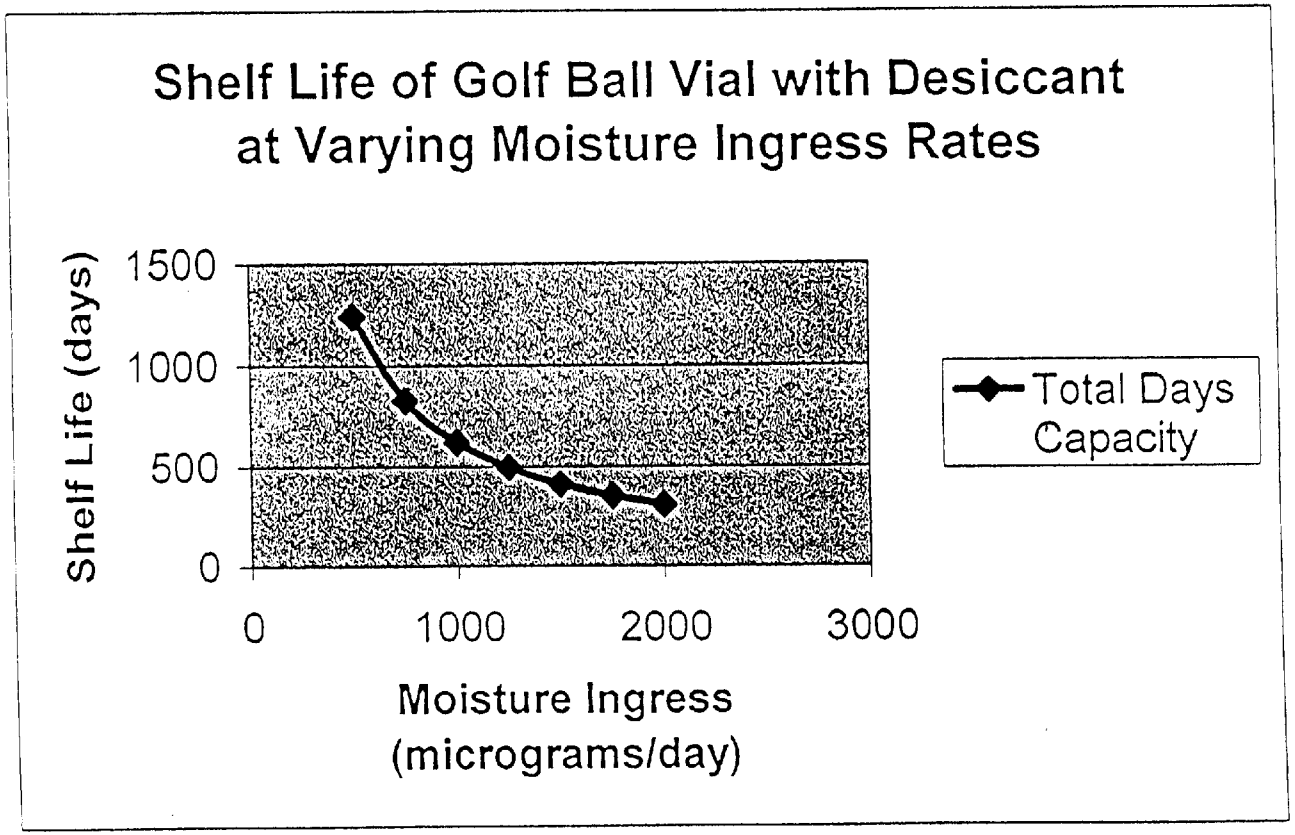
FIG. 9 is a plot of shelf life of golf balls stored in container with desiccant.

FIG. 9 shows the relationship between shelf life and moisture ingress rate of a 4.5 gram desiccant puck containing 60% (w/w) desiccant material.

What is claimed:

1. A golf ball and package assembly, comprising:

at least one golf ball; and a package separable from said golf ball, said package comprising:

(b) a moisture proof, resealable container, wherein the container has a base, an internal cavity within which said golf ball is positioned, an outer surface, an upper portion, a lower portion, and a rim at the upper portion; and (b) a cap, wherein: (i) the cap has a base and a skirt extending perpendicularly around an outer periphery of the base (ii) the cap has a ridge extending perpendicularly to the base around a path inside a path of the skirt, wherein the path of the ridge and the path of the skirt are non-circular (iii) the cap is provide with a thumb tab for facilitating opening and closing of the container, and (iv) the cap is integrally attached to the container by a hinge;

wherein the cap and container are non-circular in shape, having curved sides and flat sides;

wherein an outer wall of the ridge and an inner wall of the skirt define a gap into which the rim is fitted to form a moisture proof seal the cap is in the closed position;

wherein a desiccant insert is located at or near a bottom of the cavaity; and wherein the container has an ingress of moisture into a sealed container of less than about 500 $\mu$g/day.

2. The golf ball and package assembly of claim 1 wherein the hinge has a recess that functions as a bending point during opening and closing of the container, wherein the hinge has two elements, formed on either side of the recess, and wherein one element is attached to a flange of the container and the second element is attached to the cap.

3. The golf ball and package assembly of claim 1 wherein the container is sized to hold three golf balls.

4. The golf ball and package assembly of claim 2 wherein the package is composed of a thermoplastic.

5. The golf ball and package assembly of claim 4 wherein the recess is characterized by a relatively thinner section of plastic material which bridges thicker sections of the hinge and wherein the recess is in a location which bends relatively easily and acts as the location where the hinge folds when the lid is closed, and as the location where the hinge opens when the lid is opened.

6. The golf ball package assembly of claim 4 wherein the thumb tab has a length from about 0.125 inches to about 0.325 inches, measured from an outside perimeter of the cap to an end of the tab.

7. The golf ball and package assembly of claim 4 wherein the package is designed so that the package can be resealed by applying, in a singular motion, downward pressure upon the thumb tab or base of the cap to obtain a leakproof seal.

8. The golf ball and package assembly of claim 2 wherein the skirt overlies the container and lies upon the flange of the container while the rim of the container is situated within the gap formed by the outer wall of the ridge and the inner wall of the skirt.

9. The golf ball and package assembly of claim 4 wherein the desiccant insert takes the form of at least one of: a disc, a sleeve, and a shape that conforms to a part of the container.

10. The golf ball and package assembly of claim 2 wherein the desiccant insert includes at least one of: a thermoplastic, and polyethylene glycol.

* * * * *